US011421443B2

(12) United States Patent
Hawkinson

(10) Patent No.: US 11,421,443 B2
(45) Date of Patent: Aug. 23, 2022

(54) DOOR OPEN ASSIST

(71) Applicant: ASSA ABLOY Accessories and Door Controls Group, Inc., Monroe, NC (US)

(72) Inventor: William Arthur Hawkinson, Germantown, TN (US)

(73) Assignee: ASSA ABLOY Accessories and Door Controls Group, Inc., Monroe, NC (US)

( * ) Notice: Subject to any disclaimer, the term of this patent is extended or adjusted under 35 U.S.C. 154(b) by 343 days.

(21) Appl. No.: 16/710,354

(22) Filed: Dec. 11, 2019

(65) Prior Publication Data

US 2020/0190846 A1 Jun. 18, 2020

Related U.S. Application Data

(60) Provisional application No. 62/778,560, filed on Dec. 12, 2018.

(51) Int. Cl.
*E05B 1/00* (2006.01)

(52) U.S. Cl.
CPC ..... *E05B 1/0053* (2013.01); *E05Y 2900/132* (2013.01)

(58) Field of Classification Search
CPC ..... E05B 1/0053; E05B 1/003; E05F 13/02
(Continued)

(56) References Cited

U.S. PATENT DOCUMENTS 1,567,866 A * 12/1925 Schrader ..... E05C 3/145 292/241
2,612,372 A * 9/1952 Jamison, Jr. ..... E05B 65/0042 49/278

(Continued)

FOREIGN PATENT DOCUMENTS

DE 102006047562 A1 4/2008
EP 2439366 A2 4/2012

(Continued)

OTHER PUBLICATIONS

ASSA ABLOY Accessories and Door Controls Group, Inc., International Application No. PCT/US2019/065716, International Search Report, dated Mar. 26, 2020.

(Continued)

*Primary Examiner* — Marcus Menezes
(74) *Attorney, Agent, or Firm* — Moore & Van Allen PLLC; Jeffrey R. Gray

(57) ABSTRACT

An assist apparatus utilized within a door system to aid in opening the door. The assist apparatus may include one or more door activation devices (e.g., a first door activation device and a second door activation device, such as pulls on opposite sides of a sliding door) that can rotate around a pivot location. Moreover, the assist apparatus may further include one or more assist components operatively coupled to the one or more door activation devices. The door activation device(s) are configured to be operatively coupled to a sliding door and allow for rotation of at least a portion of the door activation device. The assist component(s) of the door activation device(s) aid in opening or closing the sliding door by engaging a door frame, wall, or the like as the door activation device is rotated.

20 Claims, 11 Drawing Sheets

(58) Field of Classification Search
USPC ..... 49/460, 32
See application file for complete search history.

(56) References Cited

U.S. PATENT DOCUMENTS 4,635,977 A * 1/1987 Yamada ..... E05B 65/0053 292/92
4,641,462 A * 2/1987 Markus ..... E05B 17/0025 16/412
5,713,614 A * 2/1998 Anderson ..... E05B 1/0053 16/413
2008/0178534 A1* 7/2008 Dando ..... E05B 17/0033 49/506
2009/0320376 A1* 12/2009 Zinn ..... E05B 17/0033 49/363
2010/0281781 A1* 11/2010 Badgley ..... B25G 1/10 49/460
2011/0107671 A1* 5/2011 Lloyd ..... E05F 11/54 49/32
2022/0010593 A1* 1/2022 McDaniel ..... E05B 1/0015

FOREIGN PATENT DOCUMENTS

EP 2644814 A1 10/2013
WO 2006126500 A1 11/2006

OTHER PUBLICATIONS

ASSA ABLOY Accessories and Door Controls Group, Inc., International Application No. PCT/US2019/065716, Written Opinion, dated Mar. 26, 2020.
ASSA ABLOY Accessories and Door Controls Group, Inc., International Patent Application No. PCT/US2019/065716, International Preliminary Report on Patentability, dated Jun. 8, 2021.

* cited by examiner

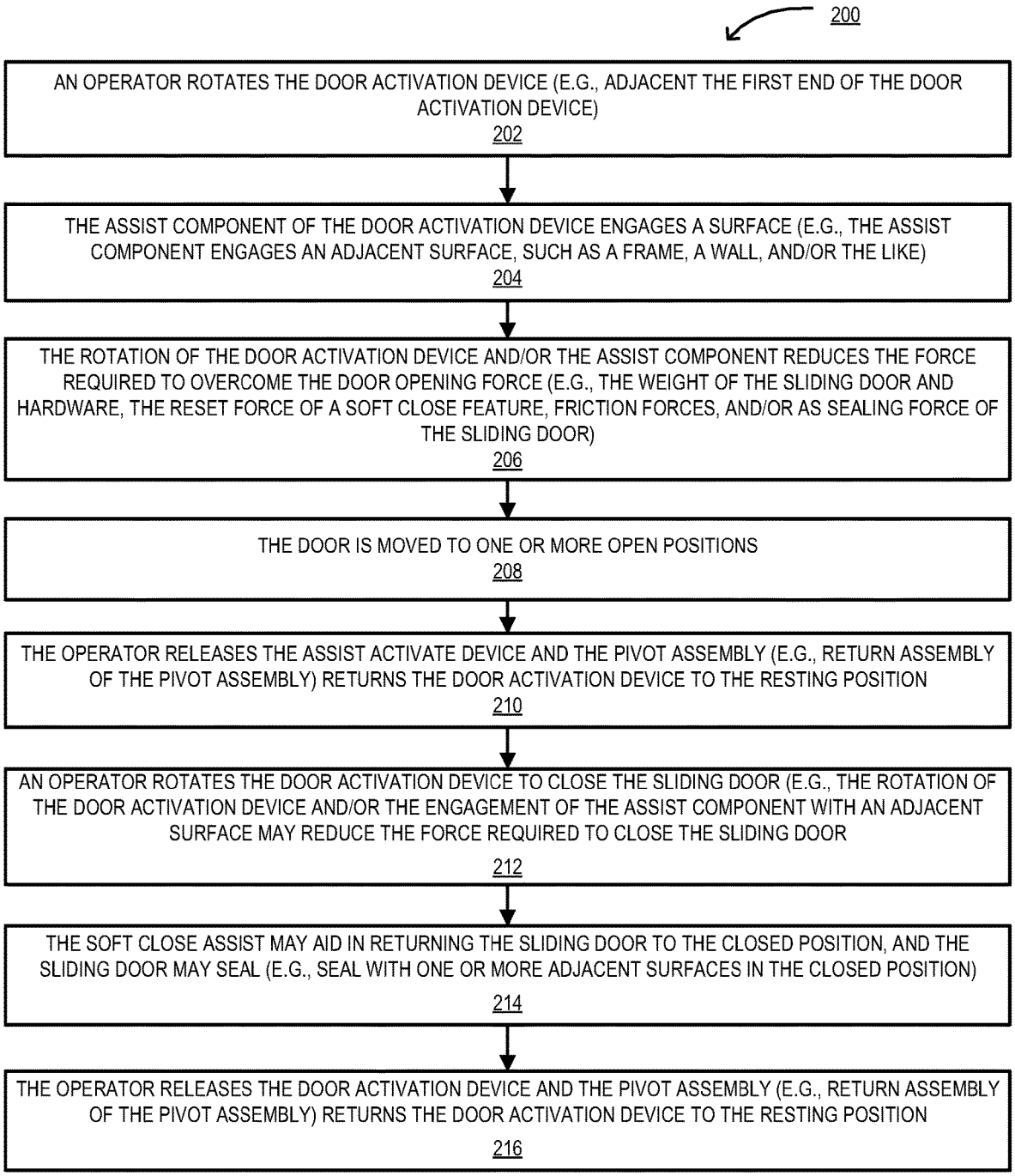
*FIG.* 11

DOOR OPEN ASSIST

CROSS REFERENCE AND PRIORITY CLAIM UNDER 35 U.S.C. § 119

The present Application for a Patent claims priority to U.S. Provisional Patent Application Ser. No. 62/778,560 entitled "Sliding Door Open Assist," which was filed on Dec. 12, 2018 and assigned to the assignees hereof, and is hereby expressly incorporated by reference herein.

FIELD

This application relates generally to the field of pulls for doors, more particularly to a pull activation device for a sliding door that assists in opening and closing the sliding door.

BACKGROUND

Doors, in particular sliding doors, may be required to provide the desired configurations for allowing people and equipment to pass, but also to provide sound proofing, gas sealing (e.g., air, or the like), debris or particulate sealing, and/or light sealing for industrial, commercial, healthcare, residential, or other facilities. In order to meet the needs of customers, sliding doors may be of a variety of sizes, utilize soft close actuators, and include elements/seals for sound, gas, debris, and/or light sealing.

BRIEF SUMMARY

The present disclosure relates to apparatuses, systems, and/or methods for improving the opening and closing of sliding doors. In particular, the present disclosure relates to utilizing an assist apparatus within a sliding door system. It should be understood that the sliding door system may comprise a sliding door, sliding door hardware, one or more frame members, seals, and/or an assist apparatus. The components of the sliding door system will be described in further detail later. The assist apparatus may be utilized to reduce the door activation force (e.g., pull force) required to overcome the opening force of the sliding door system, which may be due to the weight and/or friction of the sliding door system, the soft close apparatus reset, the sealing components in the sliding door system, or the like. The assist apparatus may comprise one or more door activation devices (e.g., a first door activation device and a second door activation device on opposite sides of the sliding door) that can rotate around a pivot location in order to aid in opening or closing a door. The door activation device may be any type of door handle (e.g., pull, knob, lever, or the like) or other type of device that when activated may allow for the movement of a door. As will be described in further detail herein, the assist apparatus may further comprise one or more assist components (e.g., wheel, ball, hemisphere, curved surface, an angular surface, a diamond shape, a curvilinear contour, a suitable geometric shape, a portion thereof, and/or the like, or an assembly with any of the foregoing) operatively coupled to the one or more door activation devices. In some embodiments, the one or more door activation devices (e.g., pull, or the like) may act as a lever, and the one or more assist components operatively coupled to the one or more door activation devices may engage and push off of one or more surfaces (e.g., one or more surfaces located adjacent to the sliding door, or apart from the door). It should be understood that the rotation of the door activation device and/or the engagement of the assist component pushing off of a surface reduces the force required to open or close the sliding door, as will be discussed in further detail herein.

One embodiment of the disclosure comprises an assist apparatus for aiding in opening of doors. The assist apparatus comprises one or more door activation devices and an assist component operatively coupled to a door activation device of the one or more door activation devices. At least one door activation device of the one or more door activation devices is configured to be operatively coupled to a door to allow for rotation of at least a portion of the door activation device, and the assist component of the door activation device aids in opening or closing the door.

In further accord with embodiments of the disclosure, the at least one door activation device comprises a pull and the door comprises a sliding door.

In other embodiments, the door activation device comprises a first end and a second end, and the assist component is configured to be operatively coupled to the second end of the door activation device.

In still other embodiments, the door activation device is operatively coupled to the door through a pivot assembly that allows for the rotation of at least the portion of the door activation device.

In yet other embodiments, the pivot assembly further comprises a return assembly operatively coupled to the one or more door activation devices, and the return assembly is configured to return the one or more door activation devices to a resting position.

In other embodiments, the return assembly comprises one or more torsion springs, one or more compression springs, one or more leaf springs, and/or one or more gears.

In further accord with embodiments of the disclosure, the door activation device is a first door activation device and is operatively coupled to a second door activation device, and the first door activation device and second door activation device are configured to rotate together.

The other embodiments, the one or more door activation devices comprise a first door activation device that is operatively coupled to a second door activation device, and the first door activation device and second door activation device are configured to rotate independently.

In still other embodiments, the one or more door activation devices comprise a first door activation device that is operatively coupled to a second door activation device, and the assist component is operatively coupled to the first door activation device. When the first door activation device is activated the first door activation device rotates independently from the second door activation device. When the second door activation device is activated the first door activation device rotates together with the second door activation device.

In other embodiments, the assist component comprises a dynamic surface.

In still other embodiments, the assist component comprises a static surface.

In other embodiments, the assist component may comprise a wheel, a ball, a cylinder, or a ring.

In yet other embodiments, the assist component comprises a circular surface or an angular surface.

In other embodiments, the assist component is removably operatively coupled to the door activation device.

In further accord with embodiments of the disclosure, the assist component of the door activation device is configured to engage with an adjacent surface located apart from the door when the door activation device is rotated into one or more engaged positions to aid in overcoming an open force or close force of the door.

In other embodiments, the open force comprises an actuator reset force associated with a soft close system of the sliding door, a sealing force of a seal formed between the sliding door and the adjacent surface, a friction force, or a weight of the door.

In yet other embodiments, the assist component of the door activation device comprises a wear component that is removably operatively coupled to the assist component, and wherein the wear component engages the adjacent surface when the door activation device is positioned in the engaged position.

In still other embodiments, the adjacent surface comprises a wear surface that is removably operatively coupled to the adjacent surface, and wherein the wear surface engages the assist component when the door activation device is positioned in the engaged position.

Another embodiment of the disclosure comprises a door system. The door system comprises a track assembly, a sliding door operatively coupled to the track assembly, and an assist apparatus. The assist apparatus comprises one or more door activation devices and an assist component operatively coupled to a door activation device of the one or more door activation devices. The at least the door activation device of the one or more door activation devices is operatively coupled to the sliding door allowing for rotation of at least a portion of the door activation device, and the assist component of the door activation device aids in opening or closing the sliding door by engaging an adjacent surface located apart from the sliding door.

Another embodiment of the disclosure comprises a method of using a sliding door system. The method comprises activating one or more door activation devices from a resting position to one or more engaging positions, wherein the one or more door activation devices are operatively coupled to a sliding door. The method further comprises engaging, in response to the activating the one or more door activation devices, an assist component operatively coupled to the one or more door activation devices with an adjacent surface located apart from the sliding door. The method comprises moving the sliding door as the assist component pushes against the surface adjacent the sliding door when a door activation force overcomes an open force of the sliding door.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein:

FIG. 11 illustrates a process for utilizing an assist apparatus within a sliding door system, in accordance with embodiments of the present disclosure.

DETAILED DESCRIPTION

Embodiments of the present disclosure now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Figure 1:
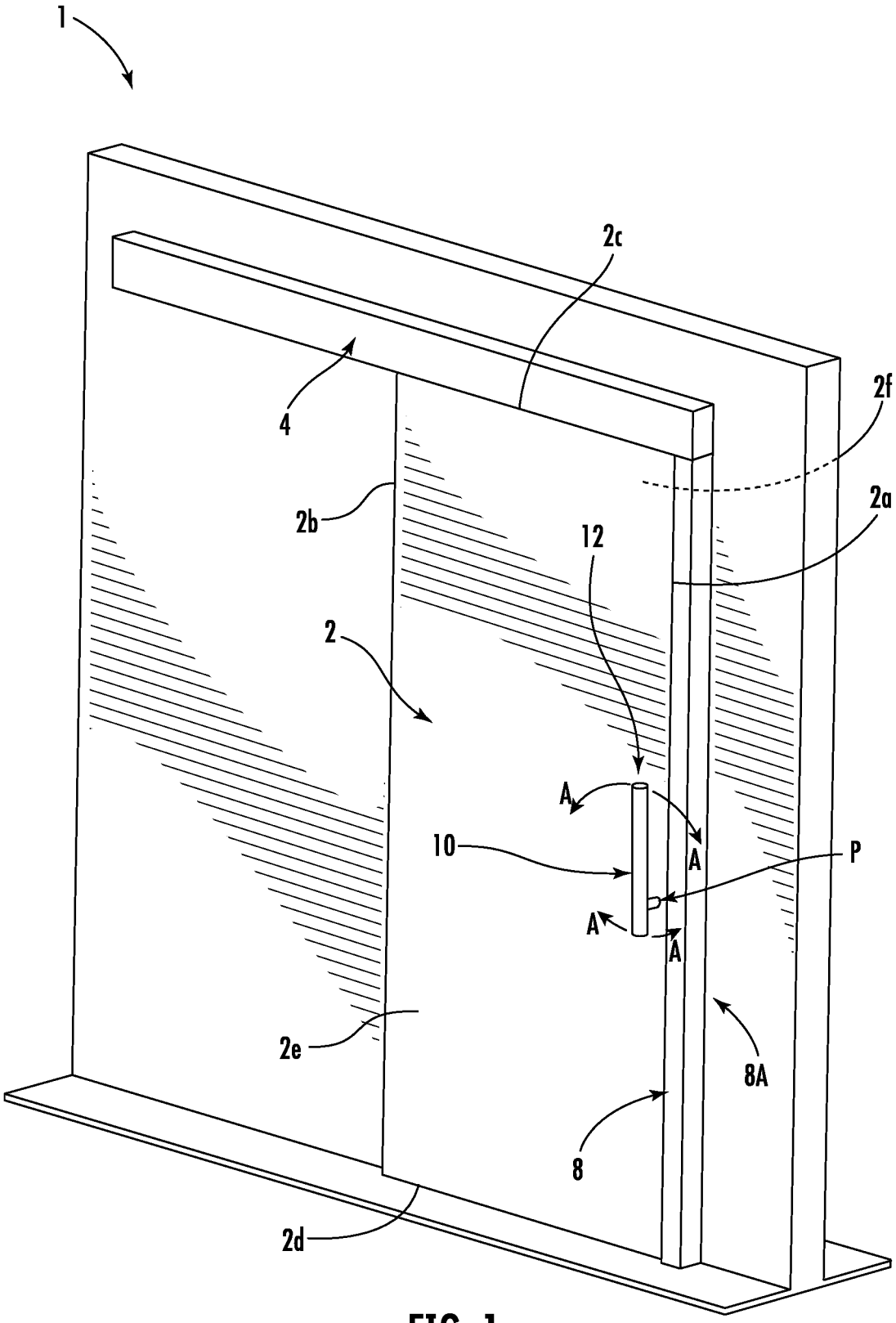
FIG. 1 illustrates sliding door with an assist apparatus, in accordance with embodiments of the present disclosure.

The present disclosure relates to apparatuses, systems, and/or methods for improving the opening and closing of sliding doors 2. In particular, the present disclosure relates to utilizing an assist apparatus 10 within a sliding door system 1. As illustrated in FIG. 1, it should be understood that the sliding door system 1 may comprise one or more sliding doors 2, sliding door hardware 4 (e.g., a track system, including tracks, wheels, supports, stops, seals, and/or the like, a soft close apparatus, including one or more actuators—not illustrated individually, and/or the like), one or more frame members 8 (e.g., frame members that surround and/or are located within the opening of door), seals (e.g., gaskets, or the like, not illustrated), and/or an assist apparatus 10. It should be understood that the sliding door 2 may be any type of sliding door, such as but not limited to sound rated sliding doors, bypass doors, pocket sliding doors, patio sliding doors, barn sliding doors, bi-part sliding doors, or any other type of sliding door. As such, it should be understood that when discussing "a sliding door" herein, this may refer to any type of sliding door, and/or one or more sliding doors (e.g., such as bi-part sliding doors, or the like). Moreover, whenever referring to a sliding door, the same or similar concepts may be used with other types of doors, such as swinging doors (e.g., hinged doors, or the like). Regardless of the type of door 2, the door 2 may have opposing edges 2*a*, 2*b*, a top edge 2*c*, a bottom edge 2*d*, and opposing sides 2*e*, 2*f* (e.g., a first or front side 2*e* and a second or back side 2*f*).

In some embodiments the one or more sliding doors may be sound rated sliding doors, projectile resistant (e.g., weather resistant, ballistic resistant, or the like), or the like, and as such, the sliding doors may include a specialized core that is used to deflect sound. Consequently, the one or more sliding doors 2 may weigh more than 200 lbs. each (e.g., for standard 3070 sized doors, doors of size 36×84 inches, or any other doors of any size). Moreover, in instances when larger doors are utilized, such as when equipment (e.g., gurneys, or the like) routinely pass through the door opening, the doors may be heavier (e.g., 225, 250, 275, or the like lbs.). The sliding doors, regardless of implementation, may weigh any value, including 175, 200, 225, 250, 275, 300, 350, 400, 450, 500, 550, 600, or the like lbs., or range between, overlap, or fall outside of any of these values. It should be further understood that in some embodiments, the sliding door hardware 4, including the soft close apparatus, may add additional weight to the sliding door 2, as well as friction (e.g., frictional force that needs to be overcome for opening the door) when opening and/or closing the sliding door 2. As such, the type of sliding door 2, the size of the sliding door 2, and/or the door hardware 4 may increase the weight of the sliding door 2, and thus, increase the force needed to open the sliding door 2. Furthermore, the soft close apparatus may utilize one or more actuators (e.g., a pneumatic actuator, hydraulic actuator, external springs, or the like) to provide a soft close action for the sliding door 2. It should be understood that when going from an open position to closed position the soft close apparatus (e.g., the actuator, or other component thereof) is activated to slow the sliding door 2 and/or control the closing of the sliding door 2. Moreover, once the sliding door 2 is closed, the soft close apparatus (or actuator thereof) has to be reset, which increases the force required to open the sliding door 2 when going from a closed position to an open position or when going from an open position to a closed position, in some embodiments. Additionally, some sliding doors 2 are used in applications that require sound proofing, gas sealing, debris or particulate sealing, and/or light sealing. In these embodiments, there may be one or more sealing components (e.g., metal seals, rubber seals, gaskets, brush seals, and/or the like) utilized in the sliding door system 1, such as on the edges or near the edges of the sliding door 2 and/or on surfaces of the one or more frame members 8 and/or wall adjacent the sliding door 2. These one or more sealing components may further increase the force required to unseal the sliding door 2 when in a closed position. As such, the weight of the sliding door 2 and sliding door hardware 4, the friction of the sliding door hardware 4, the reset of the soft close apparatus when the sliding door 2 is moving from closed to open, and/or the unsealing of seals between the sliding door 2 and an adjacent surface may contribute to one or more sliding door forces (e.g., an open force and/or a closed force) that need to be overcome in order to open and/or close the sliding door 2.

As previously discussed herein, in order to reduce the force required to overcome the weight of the sliding door 2 and sliding door hardware 4, the soft close reset (e.g., one or more actuator resets), the one or more sealing components, and/or any friction in the door hardware (e.g., friction in the track of the door hardware 4), the assist apparatus 10 may be utilized to assist in opening (and in some embodiments closing) the sliding door 2. The assist apparatus 10 may comprise one or more door activation devices 12 (e.g., a first door activation device 14, a second door activation device 16, or additional door activation devices) that can rotate around at least one pivot location. As illustrated by arrows "A" of FIG. 1, the one or more door activation devices 12 may rotate around the pivot location "P" in either direction (e.g., clockwise or counterclockwise).

In some embodiments, the sliding door 2 may comprise an open overlap configuration. Here, the sliding door 2 may not open flush with the one or more frame members 8. In this regard, the frame members 8 may comprise an overlap frame (not illustrated) and an opening frame 8A. Due to a projection of the overlap frame (not illustrated) beyond the edge of the door 8, the assist component 30 of the door activation device 12 is able to push off on the overlap frame (e.g., against a portion of the frame not being covered by or not flush with the door). In other embodiments, the sliding door 2 may comprise a flush configuration with the frame 8. In this regard, the assist component 30 of the door activation device 12 may be provided on the opposite side of the door 2 (not illustrated) that faces the opening. Here, the assist component 30 of the door activation device 12 may push off on the opening frame 8A. In other embodiments of the invention the assist component 30 may be located within the sliding door 2, flush to the edge of the sliding door 2, as will be discussed in further detail later.

As will be described in further detail with respect to FIGS. 2 through 7, the assist apparatus 10 may further comprise one or more assist components 30 (e.g., wheel, ball, hemisphere, curved surface, an angular surface, a diamond shaped surface, or another suitable geometric shape, a portion thereof, or the like, or an assembly including the foregoing) operatively coupled to the one or more door activation devices 12. As such, the one or more door activation devices 12 may act as a lever and the assist component 30 operatively coupled to the one or more door activation devices 12 may engage and push off of, or against, one or more surfaces (e.g., surfaces located adjacent to the sliding door 2), which will also be discussed in further detail herein. In some embodiments, the rotation of the one or more door activation devices 12 causes the assist component 30 to move linearly (e.g., like a plunger, or the like) to engage the one or more surfaces. It should be understood that the rotation of the door activation device 12 and/or the assist component 30 engaging and pushing off of, or pushing against, an adjacent surface reduces the force (e.g., door activation force) required to open the sliding door 2. For example, in some embodiments of the disclosure, the sliding door 2 (e.g., sound rated sliding door and associated sliding door hardware 4) may require more than 30 lbs. of force to open the sliding door 2 using a traditional static door activation device (e.g., static vertical pull, or the like), such as a pull operatively coupled to a door in two or more locations that is unable to move when coupled to the sliding door 2 (e.g., that is unable to move relative to the door). Alternatively, a rotating door activation device 12 and/or the assist component 30 operatively coupled thereto, may reduce the force needed to open the sliding door 2 to less than 15 lbs., which will be described in further detail herein. In other embodiments, for example, with respect to sliding doors that are not sound rated, utilizing the assist apparatus 10 described herein may reduce the force from approximately 12 lbs. to approximately 4 lbs. As such, an operator of the sliding door 2 may open the sliding door 2 with much more ease and with significantly less effort using the assist apparatus 10 than if the sliding door 2 had a static door activation device (e.g., status vertical pull, or the like). As illustrated in FIG. 1, the sliding door system 1 typically may include a single pull assist assembly 10; however, in some embodiments of the invention multiple pull assist assemblies 10 may be utilized. For example, independent pull assist assemblies 10 that operate independently on opposite sides 2*e*, 2*f* of the sliding door 2, on the same side of the sliding door 2 adjacent opposite edges 2*a*, 2*b* of the sliding door 2, and/or on the same side and edge of the sliding door 2 at different heights.

As discussed above, in some embodiments, the assist apparatus 10 may further comprise one or more assist components 30 (e.g., wheel, ball, hemisphere, curved surface, an angular surface, a diamond shaped surface, or another suitable geometric shape, a portion thereof, or the like, or an assembly including the foregoing) which may engage and push off of, or against, one or more surfaces. In some embodiments, the assist apparatus 10 and/or the one or more assist components 30 may engage and push off of, or against one or more surfaces that are adjacent to at least a portion of the assist apparatus 10 and/or at least a portion of the one or more assist components 30 (e.g., a surface of the frame 8, or the like). In some embodiments, the assist apparatus 10 and/or the one or more assist components 30 may engage and push off of, or against one or more surfaces that are adjacent to at least a portion of the door 2 (e.g., the frame 8, the sliding door hardware 4—such as the track or other hardware, the wall, floor, or the like). As such, it should be understood, that in some embodiments, the assist apparatus 10 and/or the one or more assist components 30 may engage and push off of, or against the floor, the ceiling, one or more tracks, any portion of the frame (e.g., vertical frame components—such as on a side of the door opening, horizontal frame components—such as above or below the door—on or within the floor), a wall above or next to the frame, and/or any component (e.g., bracket, brace, hanger, or the like) attached to any of the foregoing. In this regard, the assist apparatus 10 may comprise one or more linkages, one or more arms, one or more members, and/or other mechanisms, located within and/or outside of the door 2, that are configured for facilitating the engagement between the assist apparatus 10 and/or the one or more assist components 30 and the surfaces described above.

FIGS. 2 through 7 illustrate various embodiments of one or more assist apparatuses 10. As illustrated in the figures, the one or more assist apparatuses 10 comprise one or more door activation devices 12, such as a first door activation device 14 and a second door activation device 16. In some embodiments, the one or more door activation devices 12 may comprise any type of pull, such as but not limited to a straight rod (e.g., solid, hollow, combination thereof), a curved rod, a bent rod, or the like. As such, the one or more door activation devices 12 may comprises device ends 20, such as a first device end 22 (e.g., proximate device end, or the like) and a second device end 24 (e.g., a distal device end, or the like), and a device body 26 between the first device end 22 and the second device end 24. The one or more assist apparatuses 10 may further comprise an assist component 30 operatively coupled to at least one of the one or more door activation devices 12. In some embodiments, a single assist component 30 may be operatively coupled to one of the one or more door activation devices 12. However, in some embodiments of the invention a separate assist component 30 may be operatively coupled to each of the one or more door activation devices 12 (e.g., the first door activation device 14 and the second door activation device 16).

The assist apparatus 10 may further comprise a pivot assembly 100, which may allow the one or more door activation devices 12 to rotate from a first position (e.g., a resting position) to one or more additional positions (e.g., one or more engaged positions) when an operator rotates the door activation device 12, and thereafter, return to the resting position after the operator releases the door activation device 12. It should be further understood, that in the case of multiple door activation devices 12, the door activation devices may move together (e.g., rotate together), move independently of each other (e.g., rotate independently), or both move together and independently of each other (e.g., rotate together when a first door activation device is activated and independently when a second first door activation device is activated). As such, the pivot assembly 100 may operatively couple a first door activation device 14 to a second door activation device 16 to allow the door activation devices together, independently, or both together and independently. That said, in some embodiments, the door activation device 12 may not return to the resting position (e.g., vertical position) after the operator releases the door activation device 12. Instead, the door activation device 12 may comprise a geometry that is structured to allow the door activation device 12 to be used again after rotating by a predetermined angle/predetermined number of degrees (e.g., 45°, 60°, 90°, 110°, 140°, 180°, 270°, 360°, or the like in the direction A, or range between, within, outside, or overlap any of the forging values). In this regard, the door activation device 12 may comprise a triangular "play button shape", may comprise 3-arms forming a substantially triangular shape (e.g., a vice handle having 3 arms), and/or the like. It should be understood that in some embodiments the door activation device 12 may freely rotate 360 degrees around.

Figure 2:
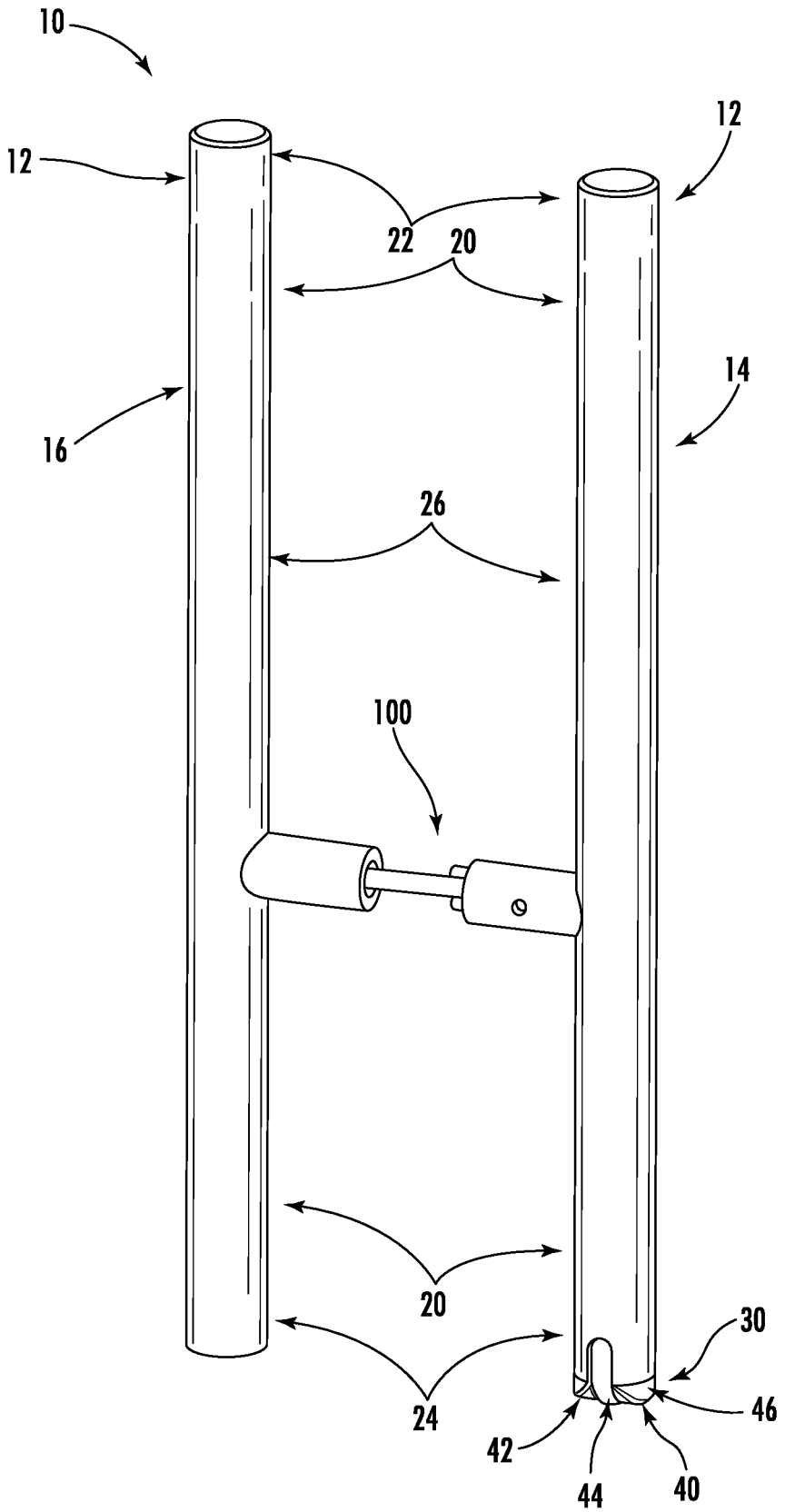
FIG. 2 illustrates an assist apparatus with two cooperating door activation devices, in accordance with embodiments of the present disclosure.
Figure 3:
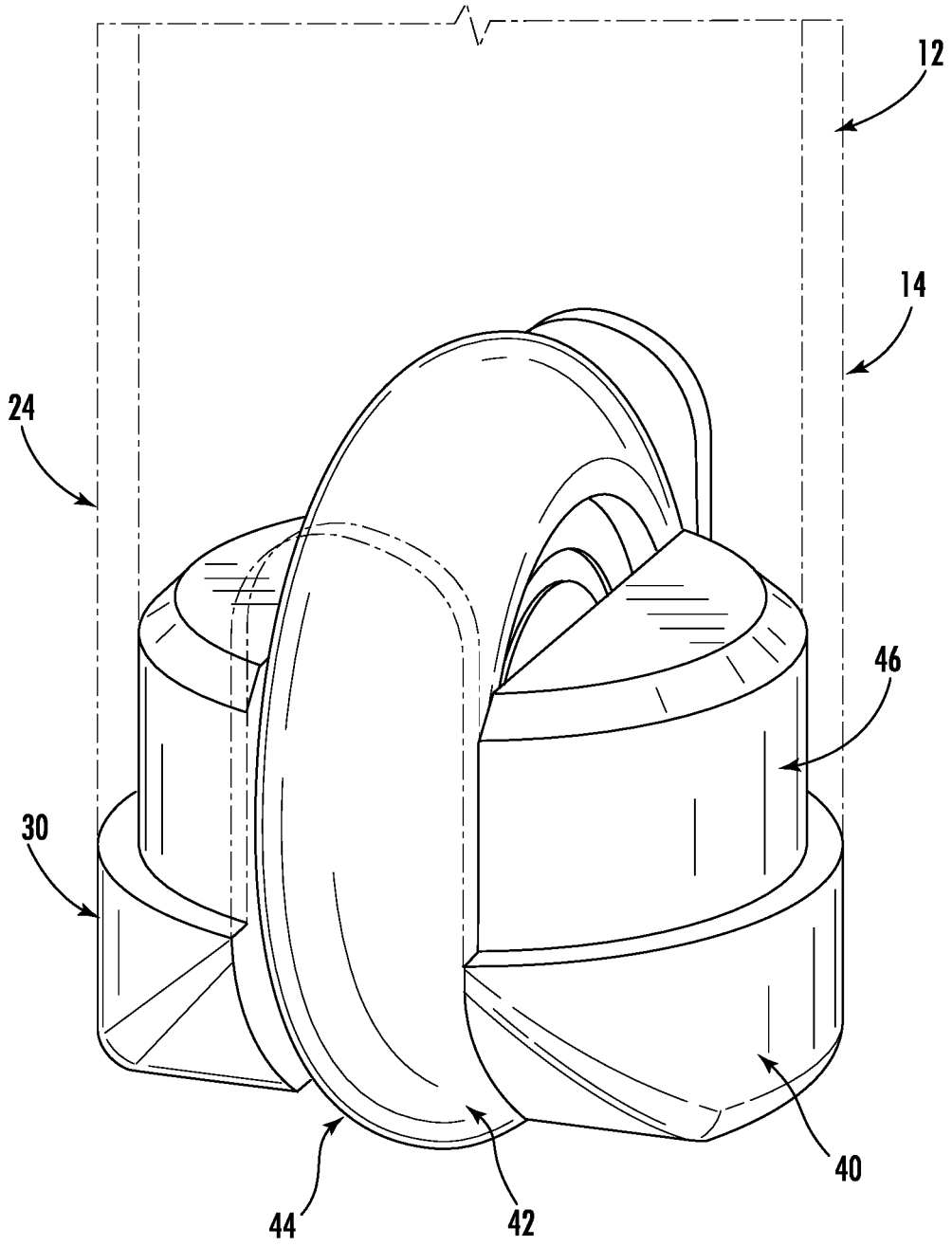
FIG. 3 illustrates an assist component of an assist apparatus, in accordance with embodiments of the present disclosure.

In some embodiments of the disclosure, as best illustrated in FIGS. 2 and 3, the assist component 30 may comprise a dynamic assist component 40, such as a wheel assembly 42. The wheel assembly 42 may comprises a wheel 44 and a plug 46 and may be removably operatively coupled to one or more door activation devices 12. In some embodiments of the disclosure, the plug 46 of the wheel assembly 42 may comprise a threaded portion (e.g., for screwing into the door activation device 12), an aperture (e.g., for receiving a set screw), a rib or depression (e.g., for mating with an opposite feature in the door activation device 12), a key or key groove (e.g., for orienting the wheel assembly), and/or have other elements that allow for operative coupling with the one or more door activation devices 12. It should be further understood that the wheel 42 may be configured to engage an adjacent surface (e.g., a surface of a frame 8, wall, or the like) when the door activation device 12 is rotated (e.g., moved from a resting position to one or more engaged positions). As the door activation device 12 is rotated, the wheel 42 contacts the adjacent surface (e.g., mating surface), and rotates as it moves along the adjacent surface, which in turn assists in moving the sliding door 2 from the closed position to one or more open positions (or from one or more open positions to the closed position).

In other embodiments of the present disclosure, the assist component 30 may comprise a ball assembly (e.g., dynamic ball assembly—not illustrated). The ball assembly may include a dynamic ball and a ball plug. The ball assembly may be similar to the wheel assembly 40, except that instead of using a wheel 42, a ball is utilized within the plug. The ball may be dynamic in that it is free to rotate within the plug in one or more directions. As such, like the wheel 42, when the door activation device 12 is rotated, the ball contacts an adjacent surface and rotates as the ball moves with respect to the adjacent surface.

Figure 4:
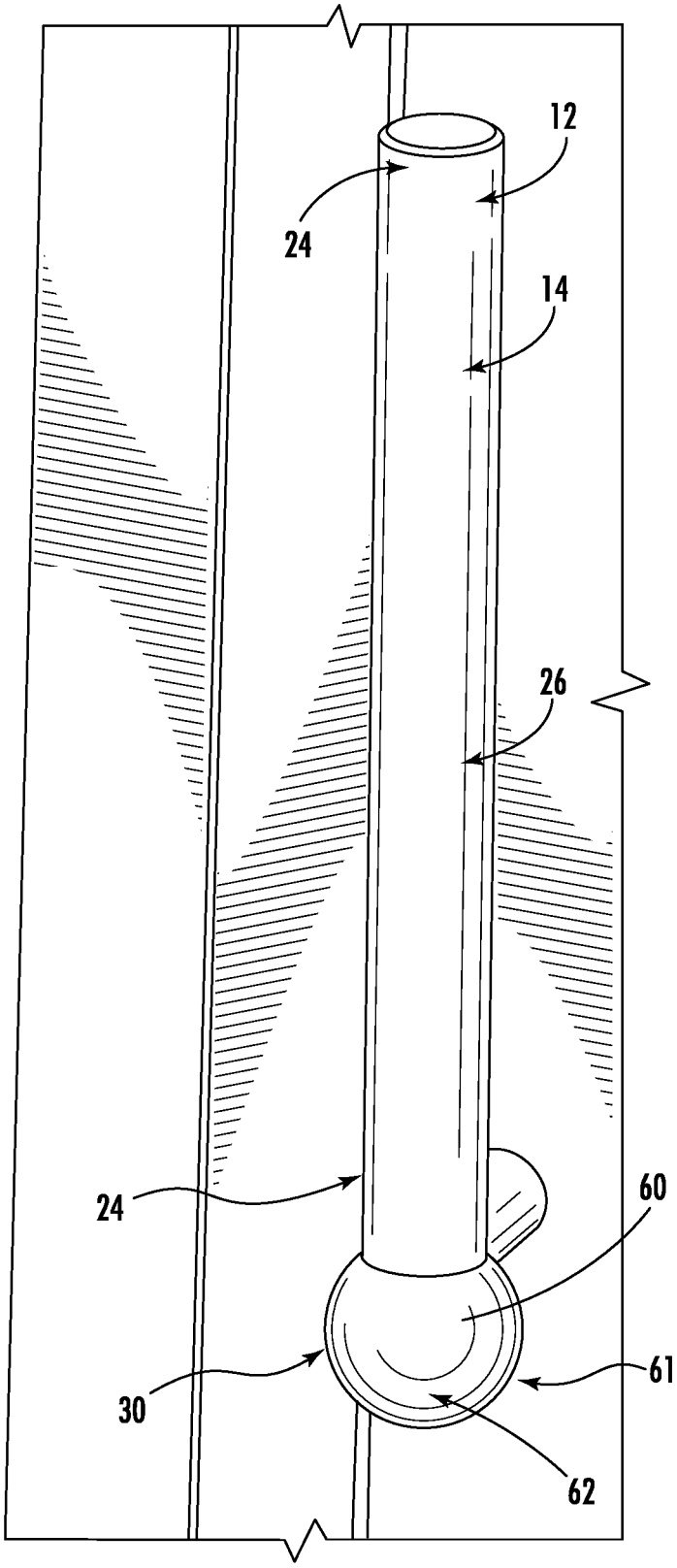
FIG. 4 illustrates an assist component of an assist apparatus, in accordance with embodiments of the present disclosure.
Figure 5:
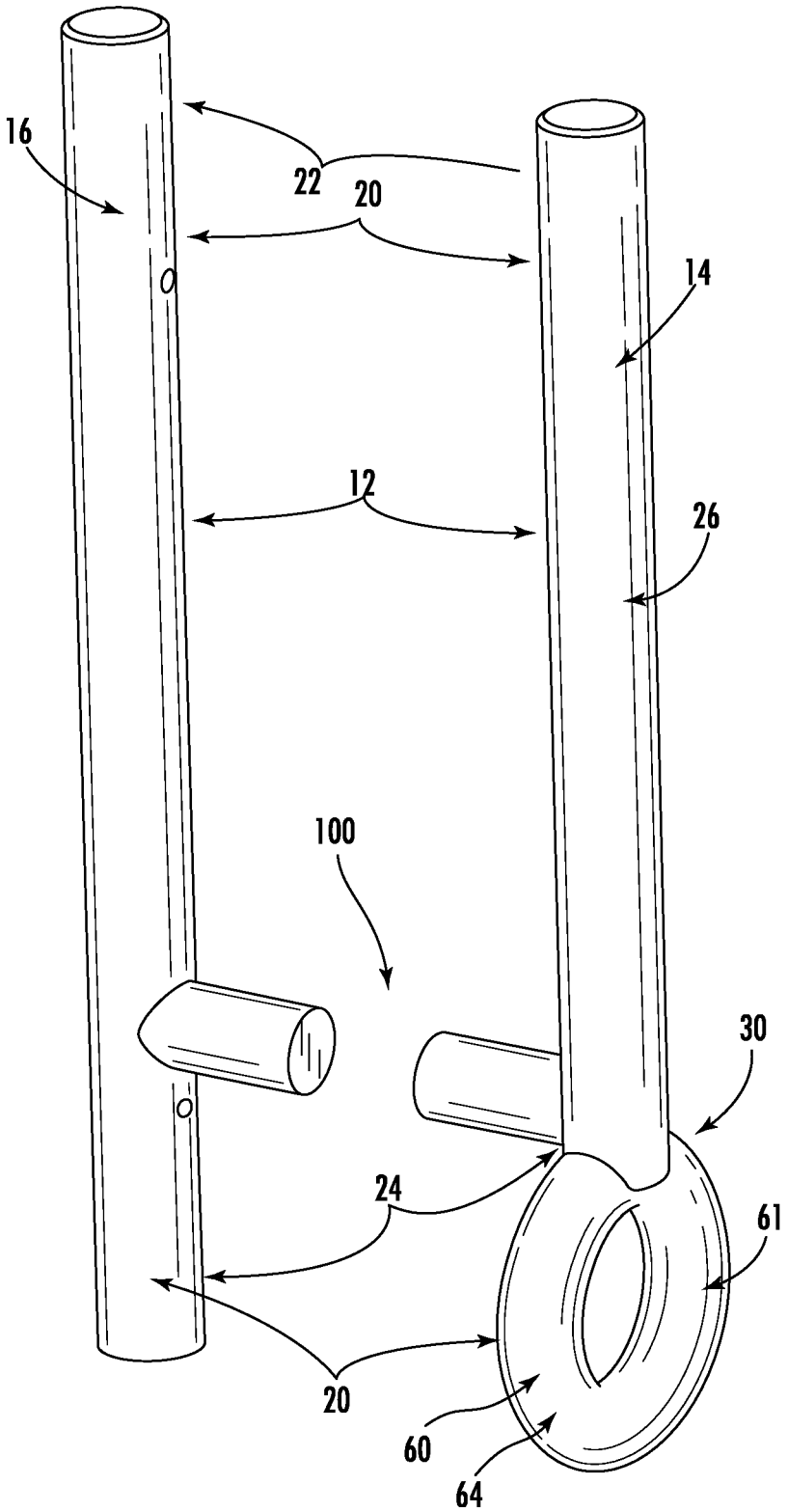
FIG. 5 illustrates an assist component of an assist apparatus, in accordance with embodiments of the present disclosure.
Figure 6:
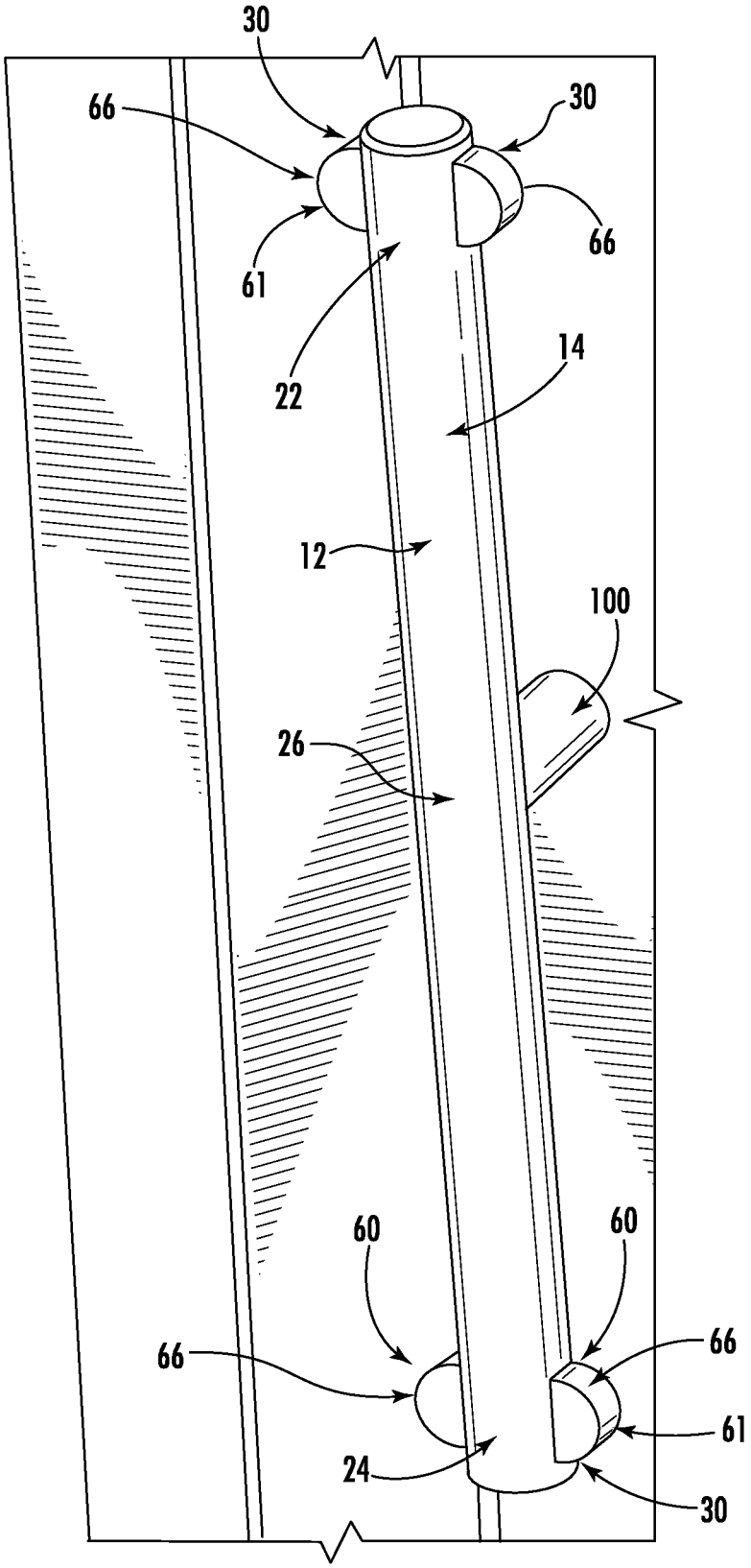
FIG. 6 illustrates an assist component of an assist apparatus, in accordance with embodiments of the present disclosure.
Figure 7:
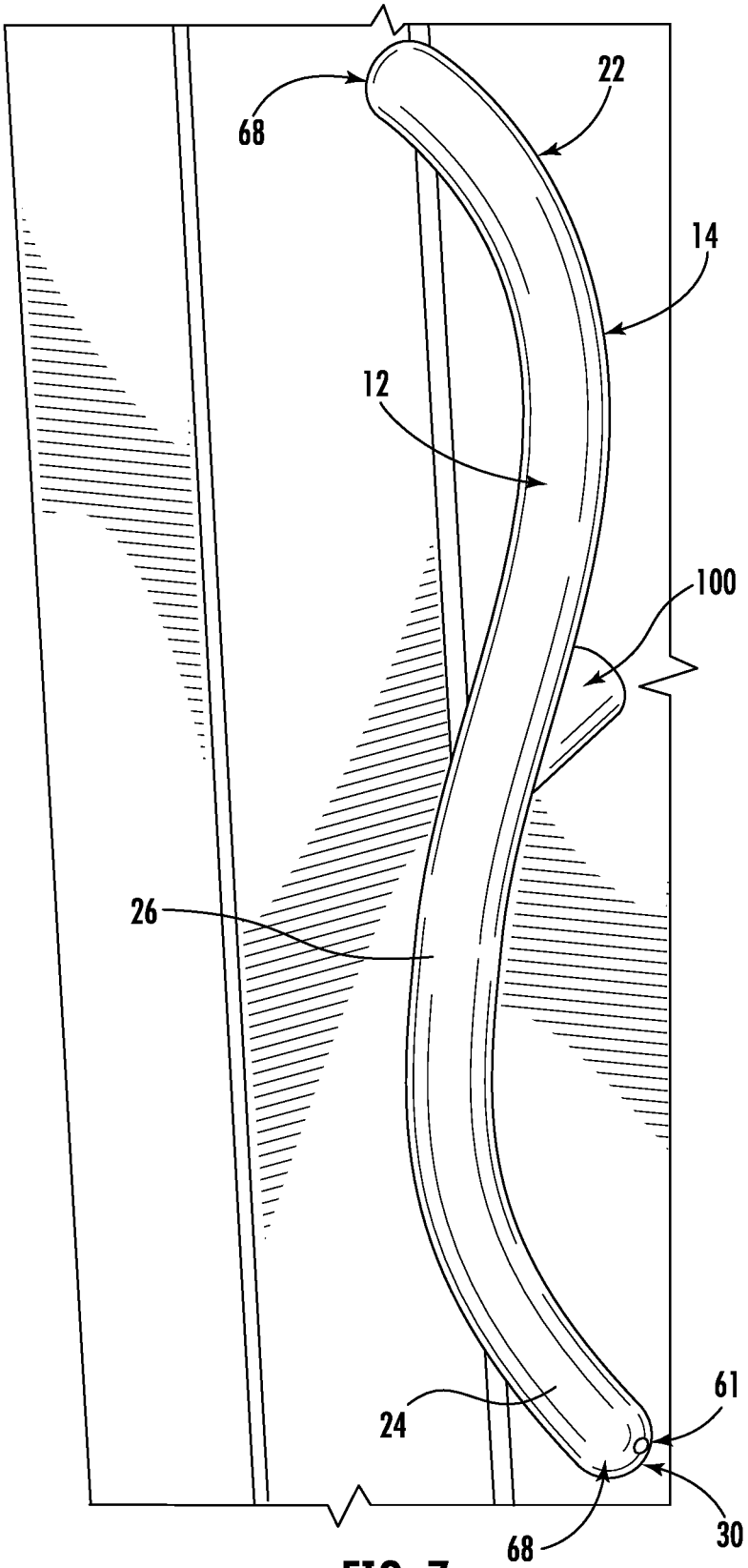
FIG. 7 illustrates an assist component of an assist apparatus, in accordance with embodiments of the present disclosure.

As illustrated in FIGS. 4 through 7, in some embodiments of the present disclosure, the assist component 30 may comprise a static assist component 60. The static assist component 60 may comprise a curved surface 61, such as a ball 62 (as illustrated in FIG. 4), a ring 64 (as illustrated in FIG. 5) or portion thereof, a cylinder 66 or portion thereof (as illustrated in FIG. 6), a hemisphere 68 (as illustrated in FIG. 7) or portion thereof, and/or any other like curved surface 61. A curved surface 61 may be utilized because as the curved surface 61 contacts an adjacent surface in order to push off of, or push against, the adjacent surface, a curved surface 61 will continue to engage the adjacent surface as the assist component 30 pushes off of, or pushes against, and moves with respect to the adjacent surface. Moreover, the curved surface 61 may cause less damage to the adjacent surface during repeated uses, in that the curved surface 61 may reduce marring, scratching, denting, or the like than could occur is a surface having an edge, point, flat area, or other like surface is used. However, it should be understood that any type of surface may be used for the assist component 30. For instance, in some embodiments, an angular surface or another geometric surface may be used. Regardless if the surface is a curved surface 61 or another geometric shape, the surface may be uniform or non-uniform, continuous or non-continuous, or the like. Like the dynamic assist component 40 described above, the static assist component 60, may be removably operatively coupled to a door activation device 12.

It should be understood that the assist component 30 may be made of, or have a portion made of any type of material, such as but not limited to nylon, steel, aluminum, plastic, rubber, composite material, and/or the like. In some embodiments of the invention, instead of removing the entire assist component 30, the assist component 30 may have a wear component that may be removable from the assist component 30. In some embodiments, the assist component 30 and/or the wear component 42 is made of a material, or has a portion that is made of a material that will reduce the damage (e.g., scratching, denting, puncturing, or the like) that could be inflicted upon the adjacent surface (e.g., frame 8, wall, or the like) by the assist component 30. Moreover, the assist component 30 and/or wear component may be replaceable when it has worn from repeated usage. Furthermore, in some embodiments of the present disclosure, the surface (e.g., adjacent surface) with which the assist component 30 engages may comprise a wear surface that is operatively coupled to the surface. The wear surface (e.g., frame wear component, or the like) may engage with the assist component 30 and/or wear component on the assist component 30. For example, the frame 8 may comprise a wear surface (not illustrated) that interacts with the assist component 30 to reduce wear, marring, scratching, denting, or the like. As such, should the wear surface wear due to the repeated contact with the assist component 30 and/or wear component thereof, the wear surface may also be replaced.

In some embodiments of the disclosure, the assist component 30 may be operatively coupled to one or more of the surfaces at the second end 24 of the door activation device 12. For example, the assist component 30 may be operatively coupled to a surface at the end of the second end 24 (e.g., as illustrated in FIGS. 2, 4, 5, and 7) and/or any location around the door activation device 12, such as any location around the outer surface adjacent to the second end 24 of the door activation device (e.g., as illustrated in FIG. 6). Moreover, it should be understood that the assist component 30 may be located adjacent the first end 22 of the door activation device 12 (e.g., as illustrated in FIGS. 6 and 7). Consequently, depending on the location of the one or more assist components 30 located on the one or more door activation devices 12, the one or more assist components 30 may be utilized to assist in opening or the closing the sliding door 2 regardless if an operator rotates the door activation device 12 from adjacent the first end 22 or the second end 24. Moreover, in some embodiments, the assist component 30 may be operatively coupled to the first end 22 of the door activation device 12, and the operator may rotate the door activation device 12 using the second end 24.

It should be understood that the assist apparatus 10, including the door activation device 12 and/or the assist component 30 have been generally described herein as being used on a single sliding door. However, it should be understood that one or more assist apparatuses 10 may be utilized within a bi-part sliding door, such as two sliding doors that may operate individually (e.g., open and shut individually), or operate in conjunction with each other (e.g., track, actuators, pulleys, gears, or the like that open and close the second door when the first door is opened or closed). Regardless of whether or not a single sliding door or multiple sliding doors are being used the assist apparatus discussed herein may operate the same way. That is, one or more assist apparatuses 10 may be operatively coupled to the first sliding door and/or the second sliding door of a bi-part sliding door system. As such, when the bi-part sliding doors are closed, a door activation device 12 (e.g., on the first sliding door or the second sliding door) may be activated (e.g., pull is rotated, or the like), and in response the assist component 30 (e.g., on the first sliding door or the second sliding door) engages and pushes off the adjacent sliding door. For example, a first door activation device 12 on the first sliding door, when rotated, moves the first assist component 30 to engage with a portion of the second sliding door (e.g., edge or overlapping portion of the second sliding door). It should be understood that in some embodiments, the second sliding door may remain stationary for a time until the first sliding door begins to move, or the second sliding door may move in conjunction (e.g., tied together through a track or other feature) with the first sliding door as the first door activation device 12 is used.

Returning to the one or more door activation devices 12, it should be understood that the length of the door activation devices 12 may vary based on the type of application and/or the desired force reduction for the sliding door 2. As described herein, the one or more door activation devices 12 of the present disclosure may act as lever to aid in opening (or potentially closing) the sliding door 2. As such, the longer the length of the door activation device 12 to the point of rotation (e.g., pivot assembly, or the like) of the door activation device 12, with respect to the length from the point of rotation to the assist component 30 (e.g., the longer the first end to the fulcrum than the fulcrum to the contact point to the adjacent wall), the greater the mechanical advantage that the door activation device 12 may provide, and thus, the larger the reduction in the force required to open the sliding door 2. As such, it should be understood that any combination of device length, first device body length (e.g., length of the door activation device from the first end to the fulcrum), fulcrum location (e.g., location of the pivot assembly 100 along the length of the door activation device), and/or second device body length (e.g., length of the door activation device from the fulcrum to the second end) may determine the reduction in the door activation force required to move the sliding door 2. It should be understood that in some embodiments, the fulcrum (e.g., pivot assembly 100) may be located adjacent to (or proximate to) the second end 24 (e.g., in comparison with the first end 22) of the door activation device 12 at various distances away from the second end 24 (as illustrated in FIGS. 2, 4, and 5). In other embodiments of the present disclosure, it should be understood that the fulcrum (e.g., the pivot assembly 100) may be located adjacent the center of the body 26 of the door activation device 12 (e.g., as illustrated in FIGS. 6 and 7). Alternatively, the fulcrum (e.g., the pivot assembly 100) may be located adjacent (or proximate) the first end 22 of the door activation device 12 (e.g., in comparison with the second end 24). Alternatively, the fulcrum (e.g., the pivot assembly 100) may be equidistant from the first end 22 and the second end 24.

Regardless of the location of the point of rotation of the door activation device 12, it should be understood that in some embodiments, the door activation device 12 may have a total length of 6, 7, 8, 9, 10, 11, 12, 13, 14, 15, 16, 17, 18, 19, 20, 22, 23, 24, 26, 27, 28, 29, 30, or the like inches. In some embodiments, the door activation device 12 may have a total length in the range of 6-10, 6-20, 6-30, 10-30, 15-30, 10-40, 10-20, and/or in-between, outside or overlapping any of the values or ranges discussed above. The pivot point (e.g., location of the pivot assembly 100) of the door activation device 12 may be located anywhere on the door activation device 12, such that the first body length (or upper body length) may be 5, 6, 7, 8, 9, 10, 12, 13, 14, 15, 16, 17, 18, 19, 20, 22, 23, 24, or the like inches. In some embodiments, the first body length (or upper body length) may be in the range of 5-10, 5-20, 5-24, 6-15, 5-15, 10-20, and/or in-between, outside or overlapping any of the values or ranges discussed above. The second body length (or lower body), which may or may not include the length of the assist component 30 may be 0, 0.5, 1, 2, 3, 4, 5, 6, 7, 8, 9, 10, 12, 13, 14, 15, 16, 17, 18, 19, 20, 22, 23, 24, or the like inches. In some embodiments, the first body length (or upper body length) may be in the range of 0-5, 1-6, 0-10, 0-24, 2-15, 10-20, 5-15, 5-20, 5-25, and/or in-between, outside or overlapping any of the values or ranges discussed above. It should be understood that the length of the door activation device 12, the first device body and/or the second device body may range between, overlap, and/or fall outside of any of the values or combinations thereof described above.

Figure 8:
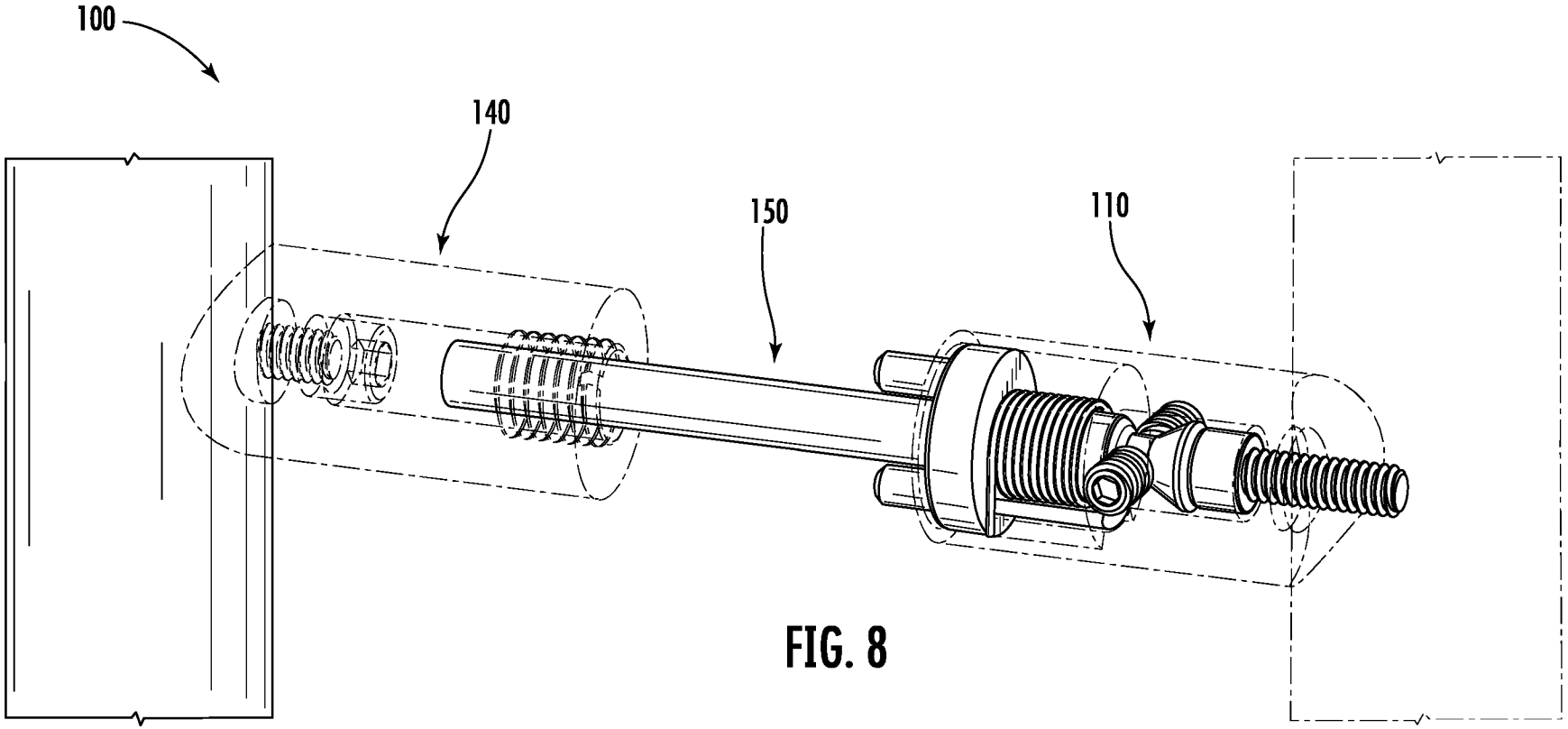
FIG. 8 illustrates a pivot assembly of an assist apparatus, in accordance with embodiments of the present disclosure.
Figure 9:
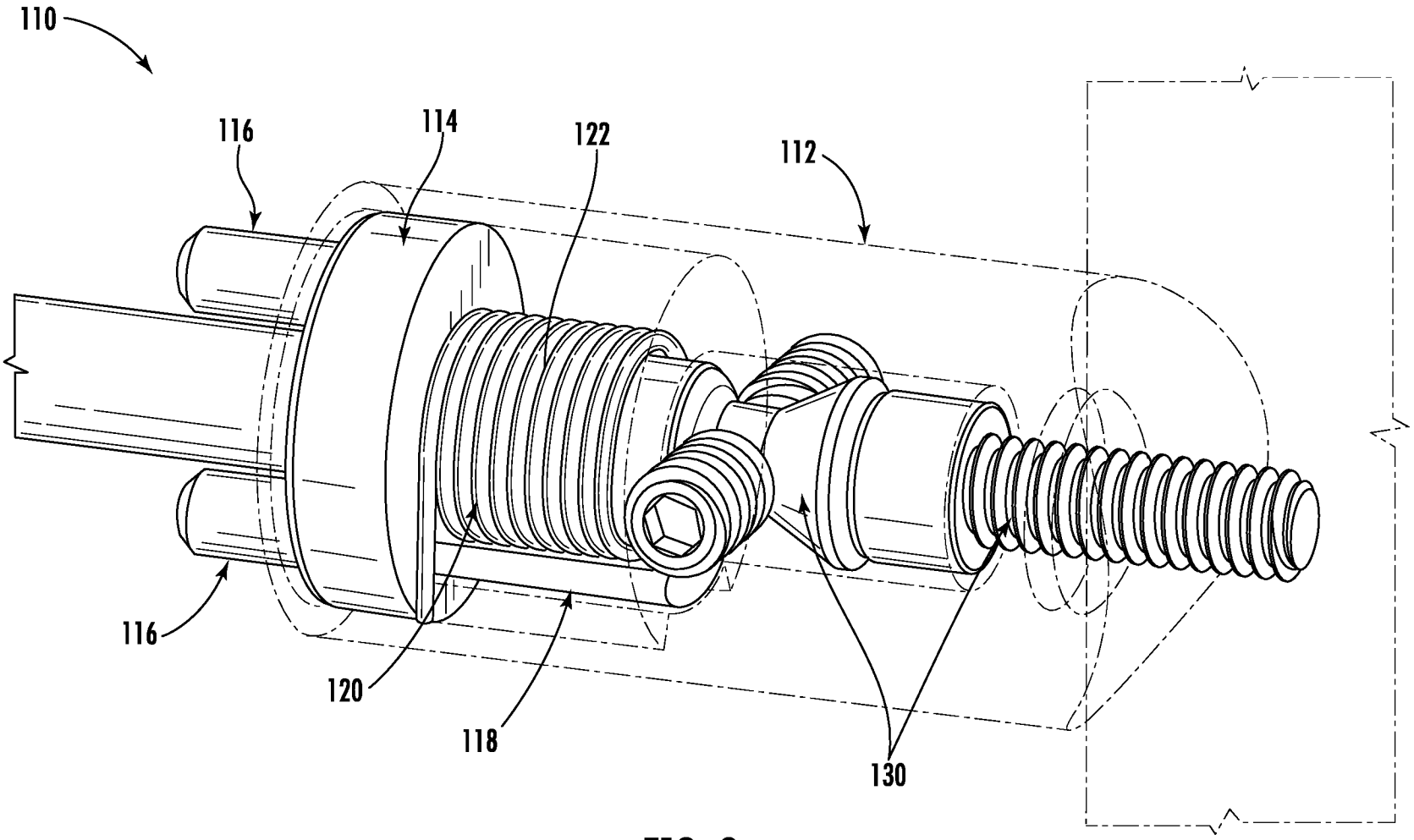
FIG. 9 illustrates a return assembly of the pivot assembly, in accordance with embodiments of the present disclosure.
Figure 10:
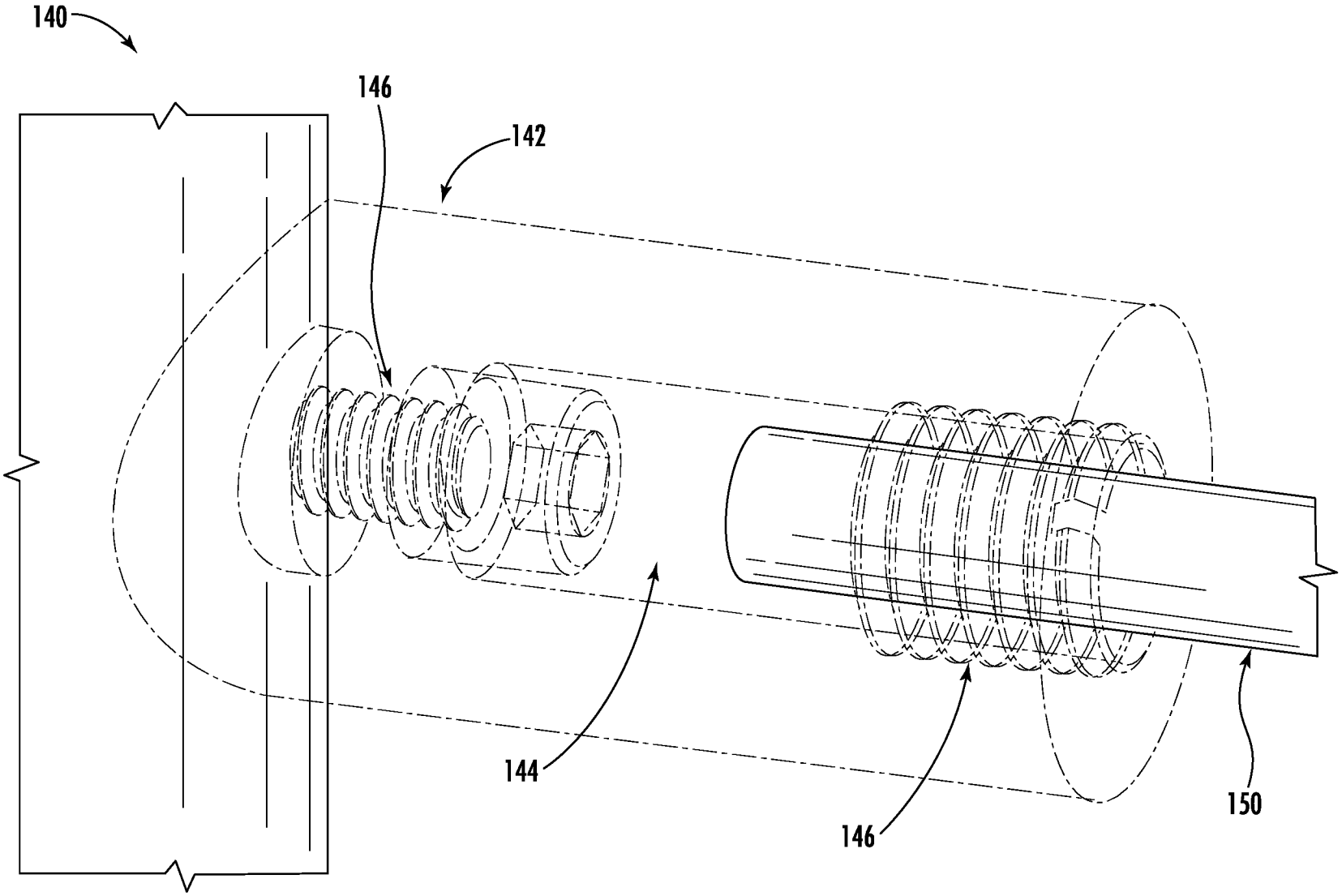
FIG. 10 illustrates a connector assembly of the pivot assembly, in accordance with embodiments of the present disclosure.

FIGS. 8 through 10 illustrate one embodiment of a pivot assembly 100 of the assist apparatus 10 previously discussed herein. It should be understood that the pivot assembly 100 may comprise any type of one or more assemblies, or one or more components thereof, which allow for the rotation of the one or more door activation devices 12, and/or the return of the one or more door activation devices 12 to an original resting location (e.g., for a pull lever) or a predetermined intermediate location (e.g., for a pull or other type of handle that may not return to its original location), after engagement. In some embodiments of the disclosure, as illustrated in FIG. 8, the pivot assembly 100 may comprise a return assembly 110, a pull connector 140, and/or one or more coupling members 150. It should be understood that in alternate embodiments, such as when the door activation device 12 rotates freely (e.g., 360 degrees in either direction), the return assembly 110 may not be required.

As illustrated in FIG. 9, the one or more return assemblies 110 may comprise a return body 112, a return flange 114, one or more flange couplings 116 (e.g., return pins, fasteners, tabs, or the like), one or more return stops 118 (e.g., return, pins, fasteners, tabs, or the like), one or more biasing members 120 (e.g., torsion spring 122, compression spring, leaf spring, and/or the like), one or more return couplings 130 (e.g., pins, fasteners, tabs, collars, or the like). The return body 112 may house at least a portion of the return flange 114, one or more flange couplings 116 (e.g., return pins, fasteners, tabs, or the like), the one or more return stops 118, the one or more biasing members 120 (e.g., torsion spring 122, compression spring, leaf spring, and/or the like), the one or more return couplings 130, and/or the like. In some embodiments of the invention the return flange 114 is operatively coupled to the one or more flange couplings 116, which in turn are operatively coupled to the sliding door 2 (e.g., within apertures within the sliding door 2, or the like). The one or more biasing members 120 may be operatively coupled to the return flange 114 and/or located adjacent the return flange 114. Moreover, the one or more return stops 118 may be operatively coupled to at least a portion of the biasing member 120 (e.g., arm, coil, end, or the like of the spring). Moreover, the one or more return couplings 130 may be rotatably operatively coupled to the first door activation device 14, to the biasing member 120, and/or the one or more coupling members 150, which are operatively coupled to the pull connector assembly 140 that is operatively coupled to the second door activation device 16.

As illustrated in FIG. 10, the pull connector assembly 140 may comprises a connector body 142, one or more connector apertures 144, and/or one or more connector couplings 146. The connector body 142 may house at least a portion of the one or more connector apertures 144, and/or the one or more connector couplings 146. For example, a first fastener 142 may extend from the second door activation device 16 and a nut may operatively couple the connector body 142 to the second door activation device 16 through a connector aperture 144. Moreover, a connector coupling 146 may be utilize for operative coupling with one or more coupling members 150.

It should be understood that in some embodiments, the pivot assembly 100, and/or in particular, the one or more biasing members 120, may allow for the rotation of the one or more door activation devices 12 at the location on the sliding door 2 of the pivot assembly 100 (e.g., fulcrum). The one or more door activation devices 12 may be rotated from a resting position to one or more engaging positions. The resting position may be vertical (e.g., vertical, substantially vertical, generally vertical, or the like). For example, as illustrated in FIG. 8, when an operator moves the first end 22 of a door activation device 12 (e.g., the first door activation device 14), the biasing member 120 (e.g., the torsion spring 122) may be engaged, and the one or more return stops 118 may cause the biasing member 120 to be biased (e.g., torsion spring is expanded or compressed). Consequently, as the one or more door activation devices 12 are rotated, the assist component 30 is used to engage the adjacent surface to aid in opening the sliding door 2. When the operator releases the one or more door activation devices 12 the biasing member 120 (e.g., torsion spring 122) is released from a biased position, and the biasing member 120 re-coils to the resting position, which returns the one or more door activation devices 12 to the original resting position.

In alternate embodiments of the invention, the biasing member 120 may comprise one or more compression springs. It should be understood the one or more compression springs may have a radius of curvature and may be located around and/or operatively coupled to the one or more return couplings 130 and/or the return flange 114. Alternatively, the one or more compression springs may be located on either side of the return couplings 130. Regardless of the orientation of the one or more compression springs, the one or more return stops 118 may compress and expand the one or more compression springs as the operator rotates the one or more door activation devices 12. Thereafter, the one or more compression springs return the one or more door activation devices 12 to the original resting position when the user releases the one or more door activation devices 12 and the one or more compression springs re-coil to the resting position.

In another alternate embodiment, the biasing member 120 may comprise a spiral spring, leaf spring, a hydraulic/pneumatic type springs, and/or other type of spring that is configured to be compressed and/or expanded when an operator rotates the one or more door activation devices 12, and thereafter, expands and/or compresses back to a resting position when the operator releases the one or more door activation devices 12. Furthermore, alternatively and/or additionally, the pivot assembly may comprise two or more gears (e.g., reducing gears, or the like) in order to further reduce the force required to open the sliding door 2 as the operator rotates the door activation device 12.

It should be understood that the one or more coupling members 150 operatively couple the return assembly 110 to the pull connector 140 to allow rotation of the first pull 14 and the second pull 16 together. In alternate embodiments of the present disclosure, the first pull 14 may rotate independent of the second pull 16. As such, in some embodiments of the present disclosure, the pivot assembly 100 may comprise two return assemblies 110 operatively coupled to each other to allow for independent movement of each door activation device 12 on either side of the sliding door 2 with respect to each other.

FIG. 11 illustrates a process 200 for the operation of the pull assist assembly 10 within a sliding door system 1. As illustrated by block 202 in FIG. 11, an operator (e.g., user, or the like) of the sliding door system 1 may rotate a door activation device 12 (e.g., a first door activation device 14, a second door activation device 16, or the like), such as by moving the door activation device 12 from a location adjacent the first end 22 of the door activation device 12, or as otherwise described herein. It should be understood that the benefits of using the door activation device 12 as a lever are increased if the force that is moving the door activation device 12 occurs adjacent the end of the door activation device (e.g., the farthest point away from the point of rotation of the door activation device). It should be understood that rotating a first door activation device 14 may or may not result in a second door activation device 16 rotating on the opposing side of the sliding door 2.

Block 204 of FIG. 11 further illustrates that the assist component 30 operatively coupled to the one or more door activation devices 12 engages one or more surfaces (e.g., engaging surface located adjacent the sliding door 2, or the like as described herein). The one or more surfaces may comprise an adjacent wall, frame 8, or the like.

FIG. 11 further illustrates in block 206 that the rotation of the door activation device 12 and/or the assist component 30 reduces the door activation force required to overcome forces related to the weight of the sliding door system 1 (e.g., weight of the door 2, door hardware 4, or other hardware attached to the door), the reset force associated with a soft close device (e.g., reset of the actuator used to assist in the soft closing of the sliding door 2), friction forces in the door system, and/or the sealing force of the sliding door 2 (e.g., in applications were a seal is used to block gases, light, particles, debris, or the like).

Block 208 of FIG. 11 further illustrates that in response to the rotation of the door activation device 12 and/or the engagement of the assist component 30, the sliding door 2 is moved from a closed position to one or more open positions (e.g., partially open, fully open, or the like).

Block 210 of FIG. 11 further illustrates that an operator releases the door activation device 12, and in response, the pivot assembly 100 (e.g., return assembly 110 and/or other components thereof) returns the door activation device 12 to the resting position (e.g., original vertical, substantially vertical, generally vertical position, or the like).

FIG. 11 further illustrates in block 212 than an operator may also rotate the door activation device 12 in order to close the sliding door 2. In some embodiments, the rotation of the door activation device 12 may itself reduce the door activation force required to close the sliding door 2. When moving from an open position to a closed position the door typically does not have to overcome an actuator reset force and/or a sealing force. As such, when closing the sliding door 2 the assist component 30 may not be needed to reduce the door activation force to close the door (e.g., the required force to close may be less than the required force to open the sliding door 2). However, in some embodiments when closing the sliding door 2, the assist component 30 may operate the same way as it operates when opening the sliding door 2. That is, the assist component 30 may engage an adjacent surface in order to reduce the force needed to close the sliding door 2.

Block 214 of FIG. 11 further illustrates that as the sliding door 2 is being closed a soft close assist in the sliding door 2 may aid in returning the sliding door 2 to closed position (e.g., automatically closes the door, or the like), and/or the sliding door forms a seal (e.g., one or more seals of the one or more surfaces of the sliding door 2 and/or the one or more adjacent mating surfaces are engaged).

FIG. 11 further illustrates in block 216 that when the operator releases the door activation device 12, the pivot assembly 100 returns the door activation device to the resting position, as previously described with respect to block 210 of FIG. 11.

It should be understood that the door activation device of the assist apparatus 10 described herein may aid in reducing the door activation force required to open a sliding door 2 (e.g., depending on the type of sliding door). For example, opening a sliding door may be the equivalent of pulling a weight of 10, 12, 14, 16, 18, 20, 22, 24, 26, 28, 30, 32, 34, 36, 38, 40, 42, 45, or the like lbs. The use of the assist apparatus 10 may allow for opening a sliding door to the equivalent of pulling a weight of 2, 3, 4, 5, 6, 7, 8, 9, 10, 11, 12, 13, 14, 15, 16, 17, 18, 19, 20, or the like lbs. As such, the assist apparatus 10 described herein may aid in reducing the door activation force required to open a sliding door 2 (e.g., depending on the type of sliding door) from 320-640, 300-700, 400-90, 320-980, 400-1300, 750-1280, 300-1300, 500-1500, and/or the like lbfs (pound-force) down to 50-100, 64-120, 40-200, 50-200, 40-150, 40-320, 40-640, 100-320, 100-640, 200-400, and/or the like lbfs (pound-force). As such, the percent reduction in the door activation force required to open the closed sliding door may be 90, 85, 80, 75, 70, 65, 60, 55, 50, 45, 40, 35, 30, 25, 20, 15, 10, or the like. The percent reduction may range from 45-90, 80-95, 75-90, 40-75, 50-78, 30-90, 10-50, and/or the like percent. It should be understood that the equivalent weights, forces, and/or percent reduction in the force needed to open the sliding door 2 may range between, within, overlap, and/or be outside of any of the above recited values or ranges.

In alternate embodiments of the invention, instead of being operatively coupled directly to the one or more door activation devices 12, the assist component 30 may be located within an aperture of the sliding door 2. In these embodiments, the assist component 30 may be inset within or sit flush with the edge of the sliding door 2. While the edges of the sliding door 2 may be the edge directly adjacent the door activation device 12, it should be understood that the assist component 30 may be located in either side edge, an upper edge, a lower edge of the door 2, any combination thereof, or the like. Regardless of the location of the edge or combination of edges of the door 2, the assist component 30 may be operatively coupled to the pivot assembly 100, which is operatively coupled to the one or more door activation devices 12. As such, as the one or more door activation devices 2 are rotated from a resting position to one or more engaged positions, the assist component 30 may move from a resting position within the edge of the sliding door to an engaging position past the edge of the sliding door (e.g., ether by extending and/or rotating out of the edge of the sliding door 2). The movement of the assist component 30 from within to outside of the edge of sliding door 2 will engage the assist component 30 with an adjacent surface and help to reduce the force required to open the sliding door 2.

Alternatively, or additionally, it should be understood that a portion of the assist component 30 may be located within the door 2, while a portion may be located outside of the door 2. As such, the assist component 30 may be located anywhere on either side 2*e*, 2*f* of the door apart from the door activation devices 12. For example, the assist component 30 may extend out of a side 2*e*, 2*f* of the door 2 and engage with an adjacent surface (e.g., in a frame, wall, floor, ceiling, or the like) at a location apart from the door activation devices 12. As such, the assist component 30 may be operatively coupled to the pivot assembly 100, which is operatively coupled to the one or more door activation devices 12. As such, as the one or more door activation devices 2 are rotated from a resting position to one or more engaged positions, the assist component 30 may move from a resting position on or within a side 2*e*, 2*f* of the door 2 to an engaging position (e.g., ether by extending and/or rotating out of the edge of the sliding door 2). Again, the movement of the assist component 30 will engage with an adjacent surface and help to reduce the door activation force required to open the sliding door 2

It should be understood that, where possible, any of the advantages, features, functions, devices, and/or operational aspects of any of the embodiments of the present disclosure described and/or contemplated herein may be included in any of the other embodiments of the present disclosure described and/or contemplated herein, and/or vice versa.

Where possible, any terms expressed in the singular form herein are meant to also include the plural form and/or vice versa, unless explicitly stated otherwise. Accordingly, the terms "a" and/or "an" shall mean "one or more." As the phrase is used herein, a processor may be "configured to" perform a certain function in a variety of ways, including, for example, by having one or more general-purpose circuits perform the function by executing particular computer-executable program code embodied in computer-readable medium, and/or by having one or more application-specific circuits perform the function.

Moreover, it should be understood that "operatively coupled," when used herein, means that the components may be formed integrally with each other, or may be formed separately and coupled together. Furthermore, "operatively coupled" means that the components may be coupled directly to each other, or to each other with one or more components located between the components that are operatively coupled together. Furthermore, "operatively coupled" may mean that the components are detachable from each other, or that they are permanently coupled together.

Furthermore, certain terminology is used herein for convenience only and is not to be taken as a limiting, unless such terminology is specifically described herein for specific embodiments. Indeed, the components may be oriented in any direction and the terminology, therefore, should be understood as encompassing such variations unless specified otherwise. The terminology includes the words specifically mentioned herein, derivatives thereof and words of similar import. For example, words such as "top", "bottom", "upper", "lower", "vertical", "horizontal", or the like are used to describe the orientation of certain features as illustrated in the Figures. Moreover, it should be understood that when using the terminology "vertical" this could mean perpendicular (e.g., 90 degrees with respect to the ground), substantially perpendicular (e.g., within +/−5, 10, 15, or the like degrees from 90 degrees with respect to the ground), generally perpendicular (e.g., +/−20, 25, 30, or the like degrees from 90 degrees with respect to the ground), or the like. Furthermore, it should be understood that when using the terminology "horizonal" this could mean parallel (e.g., 90 degrees with respect to the ground), substantially parallel (e.g., within +/−5, 10, 15, or the like degrees from 90 degrees with respect to the ground), generally parallel (e.g., +/−20, 25, 30, or the like degrees from 90 degrees with respect to the ground), or the like.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. An assist apparatus, the apparatus comprising:

a first door activation device;

a second door activation device operatively coupled to the first door activation device; and an assist component operatively coupled to the first door activation device;

wherein the first door activation device and the second door activation device are configured to be operatively coupled to a door to allow for rotation of at least a portion of the first door activation device and the second door activation device;

wherein the assist component aids in opening or closing the door;

wherein when the first door activation device is activated the first door activation device rotates independently from the second door activation device; and wherein when the second door activation device is activated the first door activation device rotates together with the second door activation device.

2. The apparatus of claim 1, wherein the first door activation device or the second door activation device comprises a pull and the door comprises a sliding door.

3. The apparatus of claim 1, wherein the first door activation device comprises a first end and a second end, wherein the assist component is configured to be operatively coupled to the second end of the first door activation device.

4. The apparatus of claim 1, wherein the first door activation device or the second door activation device is operatively coupled to the door through a pivot assembly that allows for the rotation of at least the portion of the first door activation device or the second door activation device.

5. The apparatus of claim 4, wherein the pivot assembly further comprises:

a return assembly operatively coupled to the first door activation device or the second door activation device, wherein the return assembly is configured to return the first door activation device or the second door activation device to a resting position.

6. The apparatus of claim 5, wherein the return assembly comprises one or more torsion springs, one or more compression springs, one or more leaf springs, and/or one or more gears.

7. The apparatus of claim 1, wherein the first door activation device comprises a first end and a second end, wherein the assist component is configured to be operatively coupled to the first end of the first door activation device.

8. The apparatus of claim 1, wherein the assist component comprises a dynamic surface.

9. The apparatus of claim 1, wherein the assist component comprises a static surface.

10. The apparatus of claim 1, wherein the assist component comprises a wheel, a ball, a cylinder, or a ring.

11. The apparatus of claim 1, wherein the assist component comprises a curved surface or an angular surface.

12. The apparatus of claim 1, wherein the assist component is removably operatively coupled to the first door activation device.

13. The apparatus of claim 1, wherein the assist component of the first door activation device is configured to engage with an adjacent surface located apart from the door when the first door activation device is rotated into one or more engaged positions to aid in overcoming an open force or close force of the door.

14. The apparatus of claim 13, wherein the open force comprises an actuator reset force associated with a soft close system of the door, a sealing force of a seal formed between the door and the adjacent surface, a friction force, or a weight of the door.

15. The apparatus of claim 13, wherein the assist component of the first door activation device comprises a wear component that is removably operatively coupled to the assist component, and wherein the wear component engages the adjacent surface when the first door activation device is positioned in the one or more engaged positions.

16. The apparatus of claim 13, wherein the adjacent surface comprises a wear surface that is removably operatively coupled to the adjacent surface, and wherein the wear surface engages the assist component when the first door activation device is positioned in the one or more engaged positions.

17. A door system, the door system comprising:

a track assembly;

a sliding door operatively coupled to the track assembly;

an assist apparatus comprising:

a first door activation device;

a second door activation device operatively coupled to the first door activation device; and an assist component operatively coupled to the first door activation device;

wherein the first door activation device and the second door activation device are operatively coupled to the sliding door allowing for rotation of at least a portion of the first door activation device and the second door activation device; and wherein the assist component aids in opening or closing the sliding door by engaging an adjacent surface located apart from the sliding door;

wherein when the first door activation device is activated the first door activation device rotates independently from the second door activation device; and wherein when the second door activation device is activated the first door activation device rotates together with the second door activation device.

18. A method of using a sliding door system, the method comprising:

activating a first door activation device or a second door activation device operatively coupled to the first door activation device from a resting position to one or more engaging positions, wherein the first door activation device and the second door activation device are operatively coupled to a sliding door, wherein when the first door activation device is activated the first door activation device rotates independently from the second door activation device, and wherein when the second door activation device is activated the first door activation device rotates together with the second door activation device;

engaging, in response to the activating of the first door activation device or the second door activation device, an assist component operatively coupled to the first door activation device with an adjacent surface located apart from the sliding door; and moving the sliding door as the assist component pushes against the surface adjacent the sliding door when a door activation force overcomes an open force of the sliding door.

19. The door system of claim 17, wherein the first door activation device comprises a first end and a second end, wherein the assist component is configured to be operatively coupled to the second end of the first door activation device.

20. The door system of claim 17, wherein the first door activation device comprises a first end and a second end, wherein the assist component is configured to be operatively coupled to the first end of the first door activation device.

* * * * *